US005727538A

United States Patent [19]

Ellis

[11] Patent Number: 5,727,538

[45] Date of Patent: Mar. 17, 1998

[54] ELECTRONICALLY ACTUATED MARKING PELLET PROJECTOR

[75] Inventor: Shawn Ellis, 1150 Hollowcreek La., Watkinsville, Ga. 30677

[73] Assignee: Shawn Ellis, Athens, Ga.

[21] Appl. No.: 628,850

[22] Filed: Apr. 5, 1996

[51] Int. Cl.[6] ..... F41A 19/00; F41B 11/00

[52] U.S. Cl. ..... 124/77; 124/54; 124/32

[58] Field of Search ..... 124/77, 54, 32, 124/71, 73, 3

[56] References Cited

U.S. PATENT DOCUMENTS

| | | | |
|---|---|---|---|
| 2,304,320 | 12/1942 | Tratsch | 124/77 |
| 2,550,887 | 5/1951 | Tratsch | 124/54 |
| 2,960,977 | 11/1960 | Moorhead, Jr. | 124/77 X |
| 3,192,915 | 7/1965 | Norris et al. | 124/77 |
| 3,662,729 | 5/1972 | Henderson | 124/73 |
| 3,921,980 | 11/1975 | Artzer | 124/73 X |
| 4,046,131 | 9/1977 | Clark et al. | 124/71 |
| 4,185,824 | 1/1980 | Natwick | 124/73 X |
| 4,215,867 | 8/1980 | Natwick | 124/77 X |
| 4,269,163 | 5/1981 | Feith | 124/77 |
| 4,362,145 | 12/1982 | Stelcher | 124/77 X |
| 4,424,972 | 1/1984 | Vinette | 124/77 X |
| 4,770,153 | 9/1988 | Edelman | 124/77 X |
| 5,261,384 | 11/1993 | Hu | 124/32 X |
| 5,413,083 | 5/1995 | Jones | 124/32 |

FOREIGN PATENT DOCUMENTS

| | | | |
|---|---|---|---|
| 1052245 | 11/1983 | Russian Federation | 124/77 |

*Primary Examiner*—John A. Ricci
*Assistant Examiner*—Thomas A. Beach

[57] ABSTRACT

This invention is an airgun that is loaded and fired electronically. It is comprised of an "electronic decision maker" 12 capable of accepting input and supplying output, sensors (8, 22, 24, 26) to report to the decision maker 12 the condition of various parts of the airgun or the projectile 18 to be fired, and actuators (2, 28, 4) that will effect the operations required to load and fire the airgun and are capable of responding to the commands of the decision maker 12 so it may 'oversee' these operations. The present invention will be applicable to paintball, bb, pellet, and other projectile firing airguns. Instead of relying on unreliable and "dumb" mechanical mechanisms, this airgun senses its projectile 18 and mechanism positions to determine when it can fire, using an electronic decision maker 12. This decision maker 12 can also be used to determine firing rate and velocity, adding more flexibility than a fixed, mechanical determination of these functions. Mechanical airguns cannot be reliable if fully-automatic because their loading mechanism is not consistent enough and will load paint-balls, bbs, pellets, etc., at different rates. Because projectiles 18 load into an airgun's chamber at different rates, a mechanical fully-automatic airgun would often chop its projectile 18 and foul the workings. The present invention will fire on fully automatic only as fast as its sensor 22 detects the projectile 18 presence in the barrel 10. Since the present invention waits for the projectile 18 to fall into the barrel 10 before it works its bolt 38, the electronic airgun should eliminate projectile-chopping. Using an electronic circuit 12 to trigger the airgun gives the electronic airgun the ability to fire full-automatic, three-round burst, or semi-automatic with a flick of a switch. Most prior designs use compressed gas to operate the airgun's mechanisms; since the present invention uses an electrically powered loading mechanism, it will improve compressed gas efficiency and recoil over mechanical designs.

7 Claims, 4 Drawing Sheets

ELECTRONICALLY ACTUATED MARKING PELLET PROJECTOR

BACKGROUND—FIELD OF INVENTION

The present invention relates in general to airguns and in particular to an electronically controlled airgun to be used for paintballs, BB's, pellets, and similar projectiles.

BACKGROUND—DESCRIPTION OF PRIOR ART

Prior technology airguns are strictly mechanical in their operation. They are made to fire projectiles ranging from pellets to paintballs using a compressed-gas source. Compressed gas sources could include a manually-pressurized chamber (the type of airgun that must be "pumped up") or tank filled with pressurized or liquefied gas. In a mechanical airgun, after the projectile is loaded into the barrel of the airgun by a bolt of some kind, gas is released by a valve or similar apparatus to fire the projectile. These mechanical airguns are made in two main types: manually operated and automatically operated. The main type of mechanical airgun this invention is intended to replace is the paintball-firing varieties. These type of paintball-firing airguns are typically referred to as "paintguns." A paintgun fires a paint-filled projectile called a "paintball." This paintball is designed to break on its target and thus deliver its paint to the target surface. These paintballs are usually spherical in shape and have a fragile outer shell. They are usually contained in a magazine located on the top of the paintgun. From this magazine, the paintballs fall, by gravity, into the paintgun. This most common of feed mechanisms is called "gravity-feed." Paintballs sometimes accidentally break in the paintgun, because they are designed to break on their targets. This breakage results in a messy situation that usually hinders or stops the operation of the paintgun. Most gravity-fed paintguns must have some sort of paintball-indexing system. This paintball-indexing system is some sort spring, spring-loaded tab, rubber gasket, or similar device that prevents more than one paintball from falling into the paintgun from the magazine while the bolt is open. This paintball-indexing system can frequently be a source of problems for paintguns. If set with too much spring-tension, the paintball-indexer could deform or break paintballs as they are pushed past it by the bolt. If set with out enough tension, the paintball-indexer could allow more than one paintball to be loaded into the barrel by the bolt. This double feeding problem almost always results in disaster for the paintgun. Two paintballs firing from the same barrel will usually break each other in that barrel, causing a mess in the barrel which can hinder accuracy and even break more paintballs. Mechanical airguns usually need some sort of velocity adjustment. This is because the airgun could fire its projectile at one velocity on a certain day and another velocity on the next day. This variation in velocity is caused by a change in the pressure of the airgun's compressed gas source, change in lubrication levels, or a slight change in the size and shape of its ammunition. This problem is particularly applicable to paintguns because paintballs are too fragile to withstand being fired out of the paintgun at high velocities. Thus, unless one adjusts the velocity of the paintgun down to an acceptable level, one will tend to break paintballs in the barrel of the paintgun causing the same messy problems mentioned above. Beyond the mess problems, paintguns are also usually regulated to a particular velocity if used for marking human or animals to avoid injuries. It can sometimes be difficult to achieve a velocity close to the limit, while never exceeding the limit.

The manually-operated airgun uses a manually-worked bolt to load the projectile into the chamber for firing. This type of airgun usually uses some sort of lever, pump, button, or the trigger itself to move a bolt which loads the projectile into the barrel. After loading, the projectile is fired out of the barrel by a blast of air, released from a compressed-gas source. The compressed gas is released by pressing a trigger or completing the trigger-pull that has already loaded the projectile. This gas-release is usually accomplished by a valve of some sort which is momentarily opened by a spring-driven "hammer" or similar device that strikes the valve. Adjustment of the velocity of this type of airgun's projectile is accomplished by strengthening or weakening the spring that drives the "hammer," thus making it strike the valve harder or softer, letting more or less gas escape to fire the projectile. In some cases, velocity can also be adjusted by adjusting the size of the opening between the valve and the barrel. This type of airgun is simpler, quieter and uses less gas than other types, but is complex in its operation as the operator of the airgun has to remember to work the bolt after every shot. In the case of a paintball-firing airgun, manually operated paintguns can chop the paintball in half if the bolt is worked too fast. This happens because the paintball only partially enters the airgun and the bolt chops the ball in half. This "ball-chopping" fouls the paintgun and sometimes disables it. The manually-operated bolt also makes any sort of rapid-fire difficult. The spring-tension velocity adjustment is also difficult to accomplish as it usually requires different strength springs. Adjusting the size of the opening between the valve and the barrel is more precise, but lacks consistency and predictability.

Semi-automatic and fully-automatic airguns use energy from the compressed gas source to work their bolts and reload themselves and they come in two varieties: open-bolt and closed-bolt. The semi-automatic airgun is designed to fire once per trigger pull. The semi-automatic airgun will fire only once per trigger pull, even if the trigger is held down. The fully automatic airgun will keep firing as long as the trigger is held down and will stop firing only when the trigger is released. The rate at which fully-automatic airguns fire is typically 600 to 800 firings per minute.

The first type of semi/full automatic airgun is the open-bolt. The term "open-bolt" is used because this type of airgun fires with the bolt held in the "open" or back position. The open-bolt airgun operates in much the same was as some firearms. The spring-loaded bolt is held in the back position by a sear until the trigger is depressed. Pressing the trigger of the airgun allows the sear to release the bolt. Once released, the bolt travels to the valve and strikes it. This type of valve is usually of the type that releases gas into the barrel as well as back at the bolt. The gas directed at the bolt forces it back where it is caught by the sear again. In a fully automatic airgun, the sear would catch the bolt only if the trigger had been released. Had the trigger not been released, the bolt is not caught by the sear and immediately begins traveling back towards the valve and loading a new projectile at the same time. The semi-automatic airgun only operates its sear for one cycle of the bolt, allowing only one shot per trigger pull. This open-bolt design loads a projectile and fires the projectile in one forward movement of the bolt. The bolt of the open-bolt airgun is usually connected to a secondary mechanism that loads the projectiles by using the movement of the bolt. This secondary mechanism could be another bolt connected to the first bolt by an arm or lever. This second bolt would move with the gas-firing bolt to load the projectile into the barrel just before the gas-firing bolt releases the gas to fire it. This open-bolt design facilitates rapid firing otherwise impossible with the manually-operated airgun as the operator need only pull the trigger to fire a projectile and no lever or pump operation is required. However, the open-bolt airgun's velocity adjustments are accomplished in the same way as the above manually-operated airgun and is subject to the same shortcomings. This airgun only made the paintball-chopping drawback of the above manual airgun worse, since the bolt on a open-bolt airgun can work much faster than the bolt of a manually-operated airgun. In the case of a paintball-firing airgun, this extra speed makes it even more prone to chopping gravity-fed projectiles such as paintballs. The second problem with this design is that in a paintball-firing airgun, the speed and violence of a gas operated bolt can deform the paintballs and cause breakage in the barrel. The final disadvantage of these type of airguns is their tendency to throw one's aim off during rapid-firing because of the shaking, noise, and gas-expulsion caused by the gas-operated bolt.

The second type of full/semi automatic airgun is the closed bolt. The term "closed-bolt" is used because this type of airgun fires with the bolt held in the "closed" or forward position. A closed-bolt airgun has the projectile loaded into the barrel before the trigger is depressed. By depressing the trigger, one releases the gas to fire the projectile (by opening a valve directly or releasing a hammer that opens a valve or similar mechanism). After the projectile is fired, the bolt moves "open" or back by a gas-operated-cylinder, blast of gas, or other mechanism. While the bolt is back or "open," the next projectile either falls into the path of the bolt or is pulled into the path of the bolt by the bolt's movement. The bolt then closes by a spring or other device, and the airgun is ready to fire again. This type of airgun is typically much smoother than the open-bolt style because the bolt usually moves for a shorter distance and there is less shaking and noise. The closed bolt airgun has slower bolt movement than the open-bolt designs making this design less likely to have the paintball-deforming effects of the open-bolt and also making the airgun easier to aim while firing rapidly. Closed-bolt airguns, use a complex system of gas-lines, valves, regulators, and air-cylinders which are prone to compressed gas leakage and mechanical failure. Closed-bolt airguns are typically large and unwieldy, use more gas than open-bolt designs, and are more sensitive to pressure changes in their compressed gas source than open-bolt designs. Velocity adjustment on this type of airgun is difficult. The only adjustment provided is usually a system that varies the size of the opening between the valve and the barrel which is often simply not enough adjustment to get the airgun to fire its projectile at the desired velocity. There are no fully-automatic closed-bolt airguns commonly advertised or known at this time.

As mentioned in the above paragraphs, this prior technology has several disadvantages, with most of these concentrated in the paintball-firing airguns. These disadvantages include:

(a) They have unnecessary complexity of operation. In the case of the manually-operated airgun one has to remember to operate the lever, pump, button, etc. after every shot, while the automatic closed and open bolt varieties often need to have the power with which they cycle their bolts adjusted frequently.

(b) Rapid fire is difficult. This is a disadvantage also largely restricted to manual paintgun operation. Rapid fire is difficult with the manually-operated paintgun because one must pause to operate the gun's bolt between every shot. However, rapid firing is also difficult to some degree with open-bolt full/semi-automatic airguns because of their shaking, a large gas discharge which can obstruct the operator's view, and, in the case of the paintball-firing airgun, a tendency to break paintballs while firing rapidly.

(c) Fully automatic, mechanical airguns are difficult to design. This is a disadvantage limited mainly to paintguns. This difficulty of design is evidenced by the rarity of fully-automatic paintguns and explained by the fragility of the paintball. This fragility makes the paintball prone to break or deform if placed in a spring-loaded magazine. Thus the aforementioned gravity-feed system must be used for the high-capacity magazines which a fully-automatic paintgun would need. However, these gravity-feed systems present a problem when coupled with a fully-automatic paintgun became a fully-automatic paintgun will often chop paintballs in half because it fires at the same rate, regardless of whether or not a paintball has fallen completely into the chamber. Thus a fully-automatic paintgun cannot be reliable because its rate of fire would be too fast for the fragile paintball.

(d) They have limited flexibility in firing rates. A particularly effective feature for airguns would be a burst facility that would fire a fully-automatic burst of a few shots every time the trigger is pulled. Such a facility would be difficult to design and produce for mechanically operated airguns.

(e) Velocity adjustment is difficult. Adjustment of the velocity of the projectile as it is fired from a mechanical airgun is usually facilitated by adjustment in the tension of a spring or in the size of the gas opening that the gas has to pass through to fire the projectile. These adjustment methods are usually not adequate because they are either too coarse or too fine. These velocity problems are limited mainly to paintguns intended for animal marking or paintball games use. Since these paintguns are going to be fired at animals or people, strict rules are usually imposed dictating the velocity of these paintgun's projectiles (they are normally not allowed to exceed 300 feet per second).

(f) Mechanical paintball-firing airguns tend to chop paintballs. As mentioned in disadvantage (c) above, paintball-chopping can be disastrous to the operation of a mechanical paintgun. This disadvantage effects all type of mechanical paintguns. Even the manually operated paintguns can be operated too fast, causing a chopped paintball. The open and closed bolt semi/fully-automatic paintguns also tend to chop paintballs when the trigger is operated fast enough or when the paintball just does not fall into the chamber fast enough.

(g) Fully and semi-automatic airguns are gas-inefficient; they use gas from their compressed gas source to operate the airgun. This fact makes these designs use more compressed gas than manually operated airguns. This design also often causes a large amount of gas to vent next to the airgun's operator from the bolt. This gas venting can be distracting and can obstruct vision on cold days.

(h) Noise levels are high for fully and semi automatic airguns. The blow-back operation of fully and semi-automatic airguns often causes a comparatively high level of noise. This noise can be a great disadvantage if one is trying to silence the airgun because a silencer over the barrel will not effect the gas vented from the bolt of the airgun.

(i) Most airguns are relatively unreliable. Closed bolt airguns have complex gas connections that make them prone to gas-leakage. Trigger mechanisms and linkages also tend to fail on open-bolt and manually-operated airguns.

OBJECTS AND ADVANTAGES

Accordingly, the objects and advantages of the present invention are:

(a) to provide an airgun that is simple to operate;

(b) to provide an airgun that is more stable while being rapidly discharged;

(c) to provide a more reliable fully-automatic airgun;

(d) to provide an airgun with bursting facilities, the ability to easily switch among fully-automatic, multiple-shots-per-trigger-pull bursts, and semi-automatic without sacrificing reliability or stability;

(e) to provide an airgun with a simple, one method velocity adjustment that is both accurate and predictable and which does not vary with spring tension or unreliable mechanical changes;

(f) to provide an airgun that automatically determines whether or not the projectile is totally in the chamber and only fires when this true, thus adjusting its rate of fire to agree with the projectile being completely in the chamber, making it less likely to chop projectiles.

(g) to provide an airgun that is more gas efficient than present designs; the electronic airgun will get more shots before the compressed gas source needs to be refilled (a cumbersome process in itself), not using gas from the compressed gas source.

(h) to provide an airgun that is more reliable than present designs, using only a few moving parts and solid-state electronics means the electronic airgun will perform more reliably than mechanical airguns, with less attention or breakdowns.

DRAWING FIGURES

In the drawings, closely related figures have the same number but different alphabetic suffixes. Each embodiment is represented in ready to fire and firing position, with the A suffix denoting ready to fire and the B suffix denoting firing position.

FIGS. 1A and 1B show two electronically-controlled airguns, one in the ready to fire position (1A) and the other in the firing position (1B). These airguns use an electronically actuated projectile-indexer, three electronic sensors, and a push-type bolt-actuator.

FIGS. 2A and 2B show two electronically-controlled airguns, one in the ready to fire/firing position (2A) and the other in the re-loading position (2B). These airguns use an electronically-actuated projectile-indexer, three electronic sensors, and a pull-type bolt-actuator. Unlike the other airguns shown here, they operate from a closed bolt.

Figure 1A:
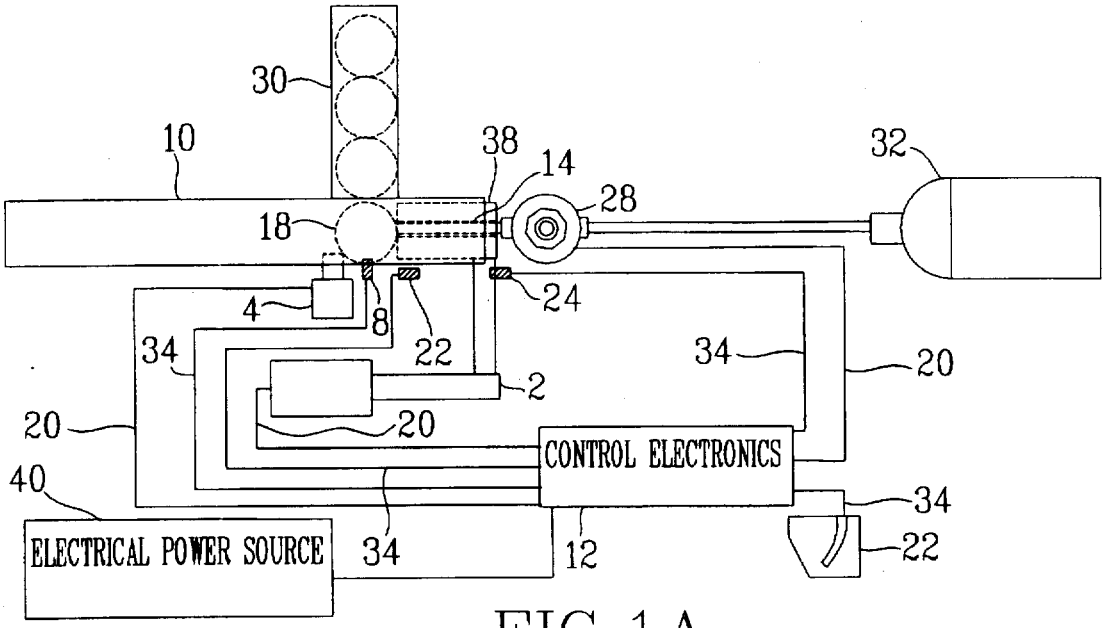

| Reference Numerals In Drawings | |
|---|---|
| 2 electronic bolt actuator | 4 electronic projectile indexer |
| 6 bolt index notch | 8 ammunition sensor |
| 10 barrel | 12 control electronics |
| 14 gas tube | 16 spring operated projectile indexer |
| 18 projectile | 20 output line |
| 22 bolt forward sensor | 24 bolt back sensor |
| 26 multi purpose sensor | 28 electronic valve |
| 30 ammunition feed tube | 32 pressurized gas container |
| 34 input line | 36 trigger switch |
| 38 bolt | 40 electrical power source |

DESCRIPTION—FIGS. 1 to 4

Figure 1B:
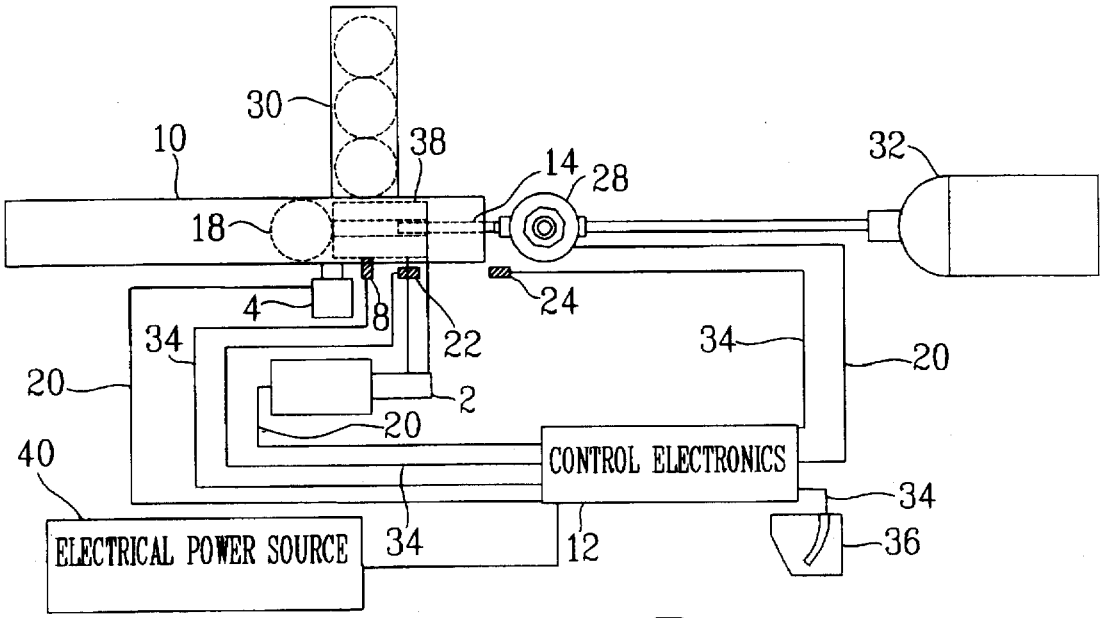

A typical embodiment of the present invention is illustrated in FIG. 1A (ready to fire view) and FIG. 1B (firing view). The airgun has an electrical power source 40 which powers the control electronics 12, electronic bolt actuator 2, electronic valve 28, electronic projectile indexer 4, and sensors 8, 22, and 24. This power source 40 could be a battery or generator or any electrical power source. The airgun also has a pressurized gas container 32 used to supply gas pressure for the airgun to fire its projectile 18. The electronic valve 28 controls this pressurized gas and allows it to pass through the center of the bolt 38 through the gas tube 14 to fire the projectile 18. This electronic valve 28 could be a solenoid, motor, or other electrically triggerable valve. The bolt 38 of the airgun loads a new projectile 18 into the barrel 10 after firing. The bolt 38 is actuated by the bolt actuator 2. This bolt actuator 2 could be a motor, solenoid, or other electrically moveable device. The electronic projectile indexer 4 ensures that only one projectile 18 enters the barrel 10 by not allowing the first projectile 18 to enter the barrel 10 until the bolt 38 has already moved to block other projectiles 18 from entering the barrel 10 through the ammunition feed tube 30. This electronic ball indexer 4 could be operated by a motor, solenoid, or other electronically moveable device. The bolt-back sensor 24 prevents premature triggering of the airgun by notifying control electronics 12 when the bolt 38 is fully back and the airgun is ready to fire again. The bolt-forward sensor 22 tells the control electronics 12 when the bolt 38 is fully forward and the projectile 18 fully loaded so the gas can be released by electronic valve 28. The projectile sensor 8 tells the control electronics when the projectile 18 is fully loaded into the barrel 10. These sensors could be switches, optical sensors, or other electronic sensor that provides feedback to the control electronics 12. The present invention also has a trigger switch 22 that tells the control electronics 12 when the operator wishes to fire the airgun. The electronic bolt actuator 2, electronic valve 28, and electronic projectile sensor 4 are all operated from the control electronics 12 by output lines 20. The bolt back sensor 24, bolt forward sensor 22, projectile sensor 8, and trigger switch 22 are all monitored by the control electronics 12 through the input lines 34. These input 34 and output lines 20 are drawn to represent the logical connection among all of these devices and the control electronics 12; they represent the actual electrical connections that would be necessary to perform the operations described herein. The control electronics 12 could be a set of logic chips, a microprocessor, or other decision-making device that can monitor the airgun's sensors 8, 22, 24, and trigger switch 22 to decide when to actuate the airgun's electronic projectile indexer 4, electronic bolt actuator 2, and electronic valve 28.

Figure 2A:
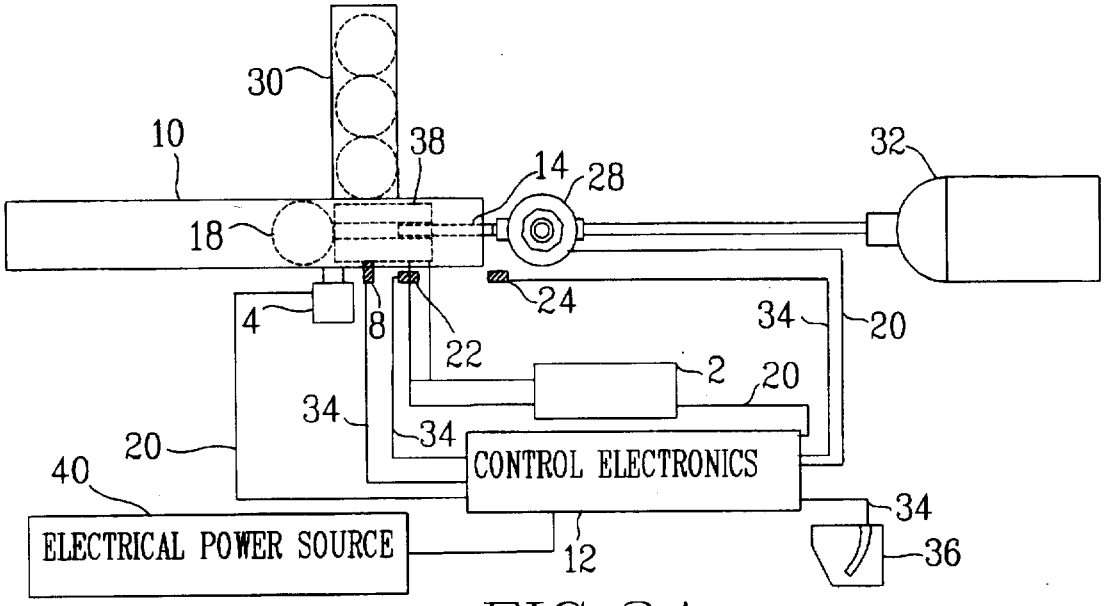
Figure 2B:
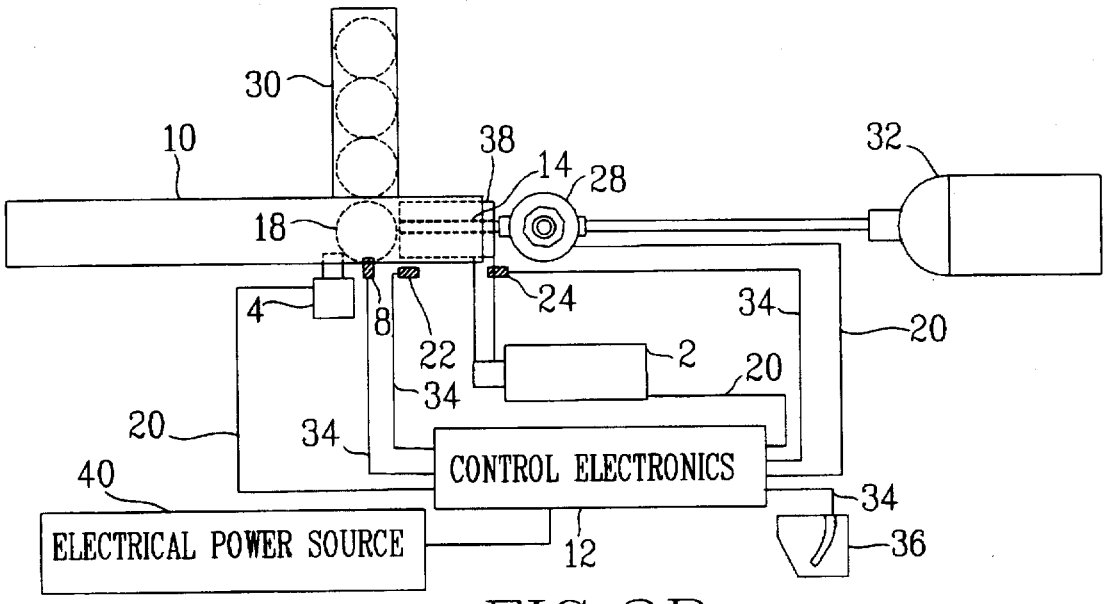
Figure 3A:
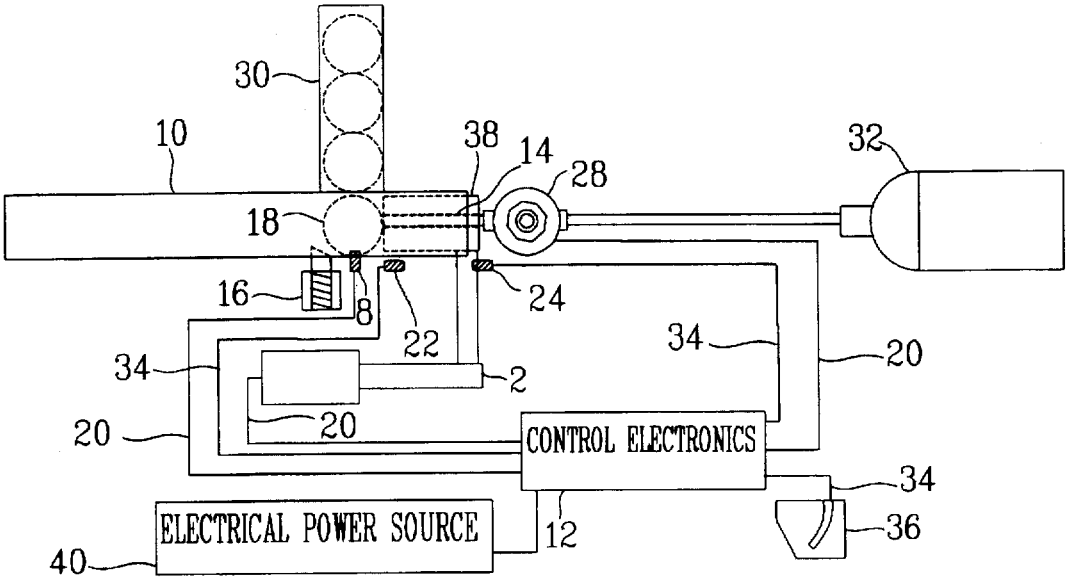
FIGS. 3A and 3B show two electronically-controlled airguns, one in the ready to fire position (3A) and the other in the firing position (3B). These airguns use an spring actuated projectile indexer, three electronic sensors, and a push-type bolt-actuator.
Figure 3B:
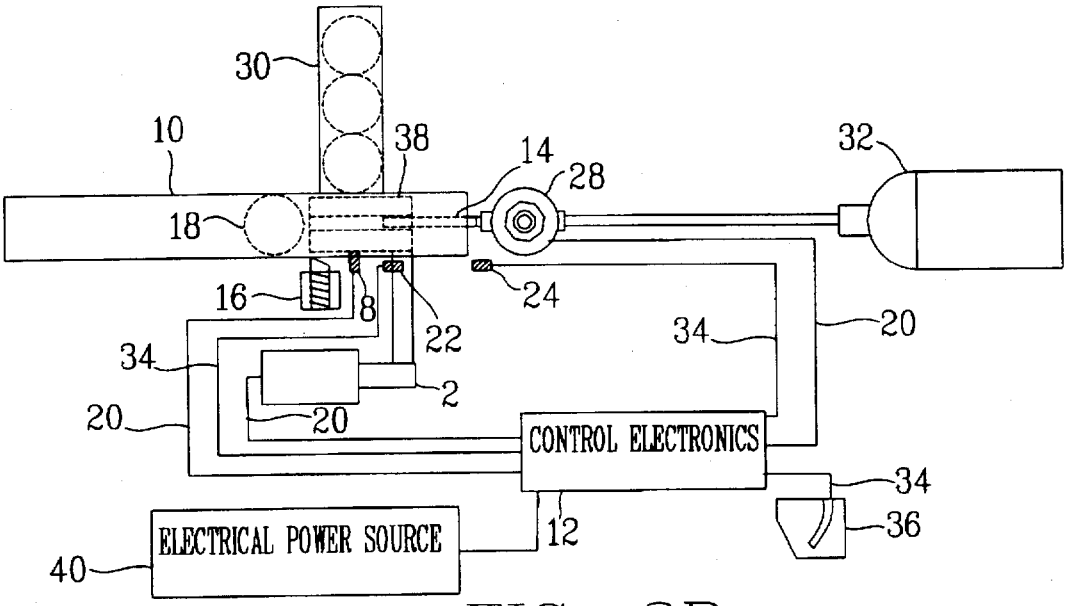

Additional embodiments are shown in FIGS. 2, 3, and 4, in each case the airgun is shown in both ready to fire and firing states. The ready to fire state is shown in the figures with the A suffix, firing state is shown in figures with the B suffix. FIG. 2 contains the same parts as FIG. 1, the difference is that FIG. 2 shows a push-type electronic bolt actuator 2. Instead of pulling on the bolt 38 to load the projectile 18, this electronic bolt actuator 2 pushes on the bolt. FIG. 2 is meant to represent a different concept of airgun operation. This concept is the same one described above as "closed bolt" operation. The closed bolt airgun's ready to fire position is with the bolt closed and projectile loaded into the barrel. Thus the ready to fire position and the firing position become the same. The airgun stays in the ready to fire position until the compressed gas is released and the projectile fires. The electronic bolt actuator 2 is then energized to open the bolt 38 briefly to load another projectile 18. This could be accomplished with a pull-type electronic bolt actuator 2, but the actuator would have to remain energized while the airgun is at rest; therefore, for the actuators shown in these figures, the push-type bolt actuator 2 appears more efficient.

FIG. 3 shows the same airgun depicted in FIG. 1 except that the electronic projectile indexer 4 has been replaced with a spring operated one 16. Instead of the control electronics 12 deciding when to retract the electronic ball indexer 4, the spring operated ball indexer 16 is simply forced out of the way by the bolt 38 when it loads the projectile 18 into the barrel 10. This spring operated projectile indexer 18 could also be retracted by a separate mechanism that would retract the spring operated projectile indexer 18 as the bolt 38 moves forward.

FIG. 4 shows the same airgun depicted in FIG. 1 except there is only one multi-purpose sensor 26 and there is a index notch 6 in bolt 38. This example explains how, with some extra logic built into the control electronics 12, the single, multi-purpose sensor 12 can replace the three previous sensors (8, 22, 24,). This multi-purpose sensor 26 serves the same purpose as the three separate sensors shown in FIGS. 1 through 3 (8, 22, 24). Instead of depending on the states of three sensors to determine where the bolt 38 and projectile 18 are, this single, multi-purpose sensor 26 ends a series of off/on state changes back to the control electronics 12 as the index notch 6 in the bolt 38 activates and deactivates it. As the projectile 18 falls into the barrel 10, the multi-purpose sensor 26 detects the projectile and the control electronics can fire the airgun. As the airgun's bolt 38 moves forward to load the projectile 18, the multi-purpose sensor 26 detects the space between the projectile 18 and the bolt 38, then is briefly blocked, then detects the index notch 6 in the bolt 38. The control electronics 12 now know the bolt 38 is closed, and the compressed gas 32 can be released.

OPERATION—FIGS. 1, 2, 3, 4

The procedure for the firing of the electronic airgun is identical to the airguns presently in use. The operator simply depresses the trigger switch and the airgun fires. The electronic operation will remain transparent to the user until a problem occurs, then the control electronics 12 will prevent the firing of the airgun until the problem is corrected. These electronic safeguards allow the airgun to be operated faster, with more reliability than previous designs.

The firing of the airgun shown in FIG. 1 is begun with the activation of the trigger switch 22. The control electronics 12 monitor the trigger switch 22 and decide whether or not the operator's request to fire can be obeyed. The control electronics 12 monitor the three sensors shown in FIG. 1 (8, 22, 24). The bolt back sensor 24 must be blocked, the bolt forward sensor 22 must be open, and the projectile sensor 8 must be blocked. This state is shown in FIG. 1A. The control electronics 12 now know that the bolt 38 is in the full-rearward position, that there is nothing blocking the operation of the bolt-forward sensor 22, and that there is a projectile 18 loaded in the barrel 10. The control electronics 12 then make the decision to fire the airgun. The firing of the airgun begins with the energizing of the projectile indexer 4 by control electronics 12 through a output control line 20. The way into the barrel 10 is now clear for the projectile 18. The control electronics 12 then energize the bolt actuator 2 by way of the output control line 20 before another projectile 18 from the ammunition feed tube 30 can force its way into the barrel 10. The electronic bolt actuator 2 then moves the bolt 38 forward, loading the projectile 18 into the barrel 10. The bolt 38 then blocks the bolt-forward sensor 22 and the projectile sensor 8. The control electronics 12 are made aware of this change by the sensors through the input lines 34. The control electronics 12 now know that the bolt 38 has moved fully forward, and that the projectile 18 has been loaded into the barrel 10. This state is shown in FIG. 1B. The control electronics 12 now energize the electronic valve 28 by way of a output control line 20. Pressurized gas then flows from the pressurized gas container 32 through the electronic valve 28 and through the center of the bolt 38 by way of the gas tube 14. The gas forces the projectile 18 out of the barrel 10 at a velocity determined by how long the electronic valve 28 is energized, how far the electronic valve 28 is opened, and the pressure of the gas in the pressurized gas container 32. The control electronics 12 then de-energize the electronic valve 28 and the electronic bolt actuator 2; the bolt 38 then returns by way of a spring of reversal of the electronic bolt actuator 2. The bolt 38 then activates the bolt back sensor 24 and the control electronics 12 are now aware of the bolt 38 having returned to a rearward position. The control electronics 12 now wait for the activation of the projectile sensor 8 before another shot can be fire by the airgun. One possible disadvantage to this operation is that there is considerable movement from the moment the trigger switch 36 is activated until the projectile 18 actually leaves the barrel. This movement of the bolt 38 and projectile 18 into the barrel 10 could throw the operator's aim off before the projectile 18 is fired.

The operation of the airgun shown in FIG. 2 is the same as FIG. 1 except the bolt 38 is in the forward position before firing takes place. Once the control electronics 12 detect a trigger switch 36 activation, the control electronics 12 monitor the bolt forward sensor 22, bolt back sensor 24, and projectile sensor 8, to determine if the operator's request to fire will be obeyed. Unlike the airgun shown in FIG. 1, this airgun must be in the state shown in FIG. 2A to fire. This means that the bolt forward sensor 22 must be activated, the bolt back sensor 24 must be de-activated, and the projectile sensor 8 must be activated. The control electronics 12 now know that the bolt 38 is fully forward and that there is nothing blocking the operation of the bolt back sensor 24. The control electronics 12 will now fire the airgun by energizing the electronic valve 28 as described above in the description of the firing of the airgun in FIG. 1. After firing, this airgun will energize the bolt actuator 2 to move the bolt 38 back. Once the bolt 38 is fully back, it will block the bolt-back sensor 24, unblock the bolt forward sensor 22, and unblock the projectile sensor 8. The control electronics 12 now know that the bolt 38 is in the full-back position and will energize the electronic projectile indexer 4 to prevent more than one projectile 18 from entering the barrel 10. The control electronics 12 then wait for another projectile 18 to enter the barrel 10. This state is shown in FIG. 2B. After the projectile 18 falls into the barrel 10 from the ammunition feed tube 30 and is seen by the projectile sensor 8, the control electronics 12 de-energize the electronic bolt actuator 2 and allow the bolt 38 to return to the forward position by a spring, reversal of the bolt actuator 2, or other mechanism. The bolt 38 then returns to the forward position, pushing the projectile 18 ahead of it into the barrel 10, until it is fully forward. The control electronics 12 will now allow another firing of the airgun. This embodiment rids the airgun of the disadvantage of excessive movement before the projectile 18 can leave the barrel 10 as mentioned above, but it could have one possible disadvantage in that the bolt 38 may have to stay energized in the back position, waiting for another projectile 18 to fall into the barrel 10 if the airgun runs out of projectiles 18. This prolonged energization of the bolt actuator 2 would be wasteful of power and quickly drain the airguns electrical power source 40.

The operation of the airgun shown in FIG. 3 is the same as the airgun shown in FIG. 1 except that the electronic projectile indexer 4 has been replaced by a spring operated projectile indexer 16. This indexer is forced into retraction by the bolt 38 when it pushes the projectile 18 into the barrel 10 and springs back when the bolt 38 is retracted. This embodiment has the advantage of requiring less power from the airguns electrical power source 40, but also possesses a possible disadvantage if the projectile 18 being fired is soft, such as a paintball, since this spring operated projectile indexer 16 puts extra stress on the projectile 18 being loaded and could cause the destruction of a paintball in the barrel 10. The spring operated indexer 16 could also become weak and allow more than one projectile 18 into the barrel 10 if the airgun is held barrel down.

Figure 4A:
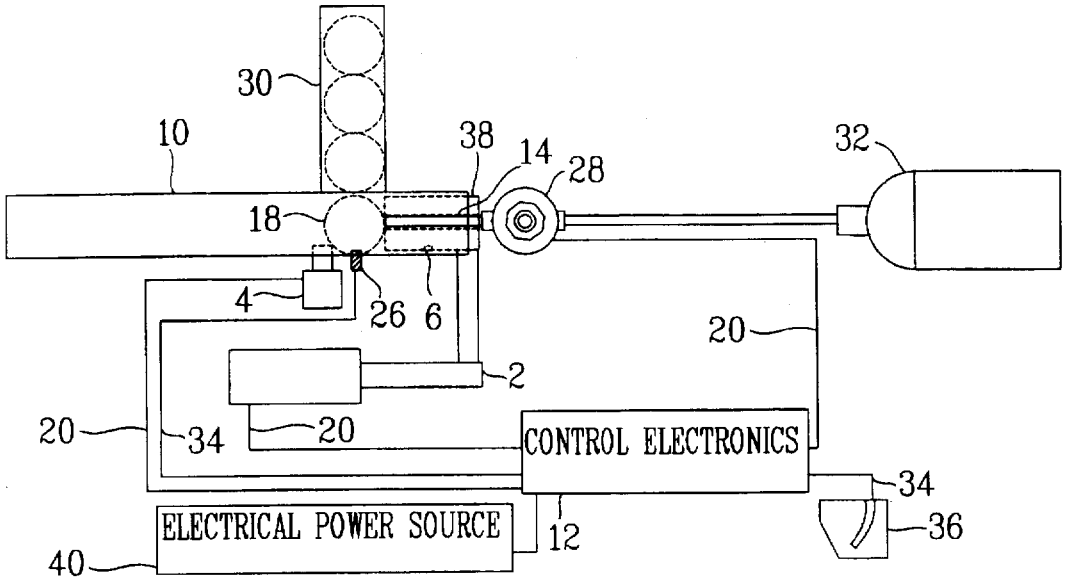
FIGS. 4A and 4B show two electronically-controlled airguns, one in the ready to fire position (4A) and the other in the firing position (4B). These airguns use an electronically actuated projectile indexer, three electronic sensors, and a push-type bolt-actuator.
Figure 4B:
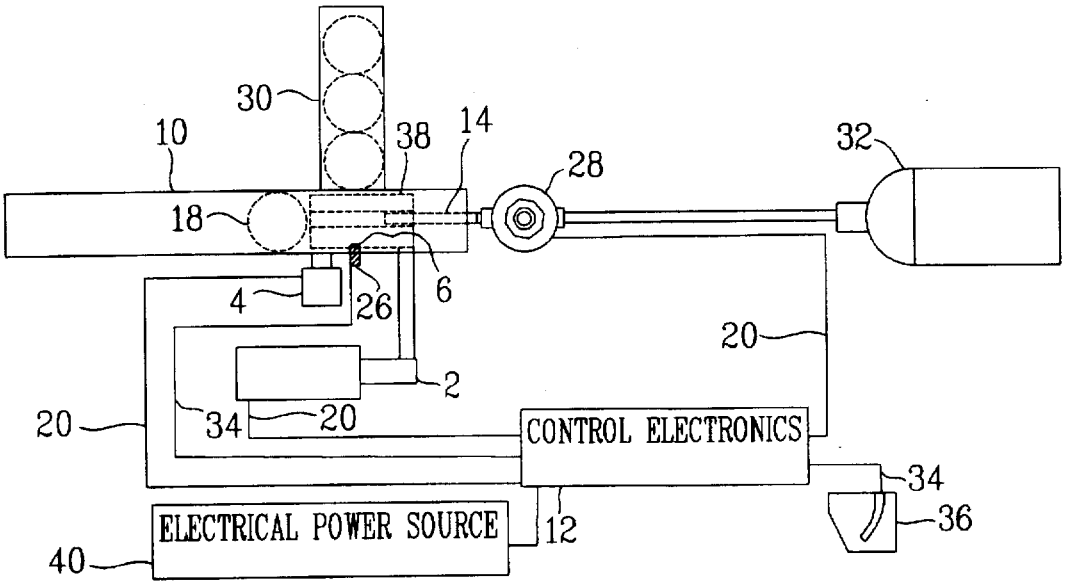

The operation of the airgun depicted in FIG. 4 is identical to the airgun in FIG. 1 except the three sensors in the airgun in FIG. 1 (8, 22, 24) have been replaced by one multi-purpose sensor 26 and the bolt 38 has an index notch 6. When the control electronics 12 in this airgun are made aware of a trigger switch 36 activation, the multi-purpose sensor 26 is checked to ensure it is blocked. The control electronics 12 then deduce there is a projectile 18 blocking the multi-purpose sensor 26 and that the bolt 38 is in the back position. This state is shown in FIG. 4A. The control electronics 12 then energize the electronic projectile indexer 4 and bolt actuator 2 as described in the above operation of the FIG. 1 airgun. As the bolt 38 moves forward, pushing the projectile 18 in front of it, the projectile 18 is moved out of the way of the multi-purpose sensor 26 and the multi-purpose sensor 26 is de-activated until the bolt 38 again blocks the multi-purpose sensor 26. The sensor 26 remains blocked until the index notch 6 in the bolt 38 is seen by the multi-purpose sensor 26 and it is again de-activated. The control electronics 12 are made aware of the multi-purpose sensor's 26 behavior by a input line 34 and count these activations and de-activations. After the control electronics 12 have been made aware of the appropriate number of state changes of the multi-purpose sensor 26, the decision will be made to energize the electronic valve 28 as described in the above FIG. 1 airgun's description. This state is shown in FIG. 4B. After firing, the control electronics 12 de-energize the bolt actuator 2 and allow the bolt 38 to return back by a spring, reversal of the bolt actuator 2, or other mechanism. The multi-purpose sensor 26 is then activated as the index notch 6 passes out of view. The multi-purpose sensor 26 remains briefly activated until the bolt 38 is back and the multi-purpose sensor 26 sees the open barrel 10. The control electronics 12 now know that the bolt 38 is in the back position by counting the activations and deactivations of the multi-purpose sensor 26. The control electronics 12 will now wait for one more activation of the multi-purpose sensor 26 by the next projectile 18 entering the barrel 10 from the ammunition feed tube 30 before another shot can be fired. This embodiment has the advantage of simplifying the wiring of the airgun by using fewer sensors, but will require more complex logic in the control electronics 12 and could be confused by a blockage of the multi-purpose sensor 26 by dirt, paint, etc.

SUMMARY, RAMIFICATIONS, AND SCOPE

Accordingly, the reader will see that the electronic airgun can be fired at a fast rate reliably, limited only by the speed at which projectiles can fall into the barrel. This airgun is also less prone to fouling its mechanisms than previous mechanical designs that do not check the positioning of the parts before firing. The electronic airgun can also be configured for a wider range of firing options than the mechanical one. This airgun could be programmed to fire three shots per trigger pull, one shot per trigger pull, or simply fire at a maximum rate as long as the trigger is activated. Furthermore, the electronic airgun has additional advantages in that

- in paintball firing applications, it alleviates the problem of chopping the paintball by using a sensor to determine the paintball is completely in the barrel before any movement can commence;
- it permits the more precise, non-mechanical adjustment of velocity by allowing one to change how long the control electronics allow gas to fire the projectile or how far the electronic valve is opened;
- it provides an airgun that is easier to service and less likely to break down, with only a few moving parts on this airgun, there fewer components that wear out than are in prior designs;
- it will be easier to manufacture than present mechanical designs which need complex, small parts machined for them; most of this airguns components can be pre-purchased from electronics distributors at relatively low cost.

Although the description above contains many specificities, these should not be construed as limiting the scope of the invention but as merely providing illustrations of some of the presently preferred embodiments of this invention. For example, the bolt shown in these figures is drawn as a piston or solenoid, but it could be a rotating bolt that loads projectiles as it turns; the bolt actuator could be pneumatic, hand operated, or motor driven; the valve could be actuated by the bolt or trigger; the sensors could be switches, optical sensors, or any electrical-feedback device; the projectile to be fired is shown as a sphere, but it could be a cylinder, cone, etc.

Thus the scope of this invention should be determined by the appended claims and their legal equivalents, rather than by the examples given.

I claim:

1. A gun for firing projectiles using fluid pressure, comprising;

a barrel;

a magazine for containing a plurality of projectiles and introducing said projectiles one at a time into said barrel into a firing position;

a bolt reciprocal in said barrel between a rearward position in which the bolt allows a said projectile to be deposited into said firing position, and a forward position in which said bolt blocks projectiles from entering said barrel from said magazine, said bolt including a through aperture to allow passage of compressed gas;

means for reciprocating said bolt;

a compressed gas source connectable to said barrel to fire a said projectile;

electronic control means for controlling said gun;

an electrically controlled valve means for controlling passage of gas from said source to said barrel;

electronic means to detect presence of a said projectile in said firing position and send a projectile presence signal to said electronic control means;

electronic means to detect whether said bolt is in said rearward or forward position and send a bolt position signal to said electronic control means;

a user actuatable trigger for sending an actuation signal to said electronic control means, whereby, when said electronic control means detects that said projectile is in said firing position and said bolt is in said rearward position, and said electronic control means receives an actuation signal from said trigger, said electronic control means will send a signal to said bolt reciprocating means to move said bolt to said forward position, and then when said electronic control means detects that said bolt is in said forward position, said electronic control means will send a signal to said valve to release gas into said barrel to fire a said projectile.

2. The air gun of claim 1, in which said electronic control means will send a signal to said valve after a predetermined time to close said valve and then send a signal to said bolt reciprocating means to return said bolt to said rearward position.

3. The air gun of claim 2, further including a sensor to detect presence of a said projectile in said firing position, and a forward sensor and a rearward sensor for detecting said forward position and said rearward position of said bolt.

4. The air gun of claim 2, further including a single sensor to detect presence of a said projectile in said firing position and to detect whether said bolt is in said rearward or forward position.

5. The air gun of claim 2, further including a projectile indexer operably connected to said barrel to ensure only one of said projectiles enters said barrel and to contain said projectile in said firing position.

6. The air gun of claim 5, wherein said projectile indexer is electronically actuated and operably connected to said electronic control means.

7. The air gun of claim 5, wherein said projectile indexer is spring actuated.

* * * * *